United States Patent [19]

Corbin, Jr. et al.

[11] 4,042,662

[45] Aug. 16, 1977

[54] CONTINUOUS MELT SPINNING AND DRAWING OF NYLON 6 YARN, WHILE REDUCING THE LIVELINESS OF THE YARN

[75] Inventors: Thomas F. Corbin, Jr.; Brewster B. Eskridge; Boyce M. Lyon, all of Asheville, N.C.

[73] Assignee: Akzona Incorporated, Asheville, N.C.

[21] Appl. No.: 452,041

[22] Filed: Mar. 18, 1974

Related U.S. Application Data

[63] Continuation of Ser. No. 36,743, May 13, 1970, abandoned.

[51] Int. Cl.[2] ..... B29C 25/00; D01F 6/60; D06M 15/12

[52] U.S. Cl. ..... 264/210 F; 106/245; 264/290 N

[58] Field of Search ..... 264/290 N, 210 F; 57/140 BY; 106/245

[56] References Cited

U.S. PATENT DOCUMENTS

| | | | |
|---|---|---|---|
| 2,291,873 | 8/1942 | Brubaker | 264/290 N |
| 3,113,369 | 12/1963 | Barrett et al. | 106/245 |
| 3,388,545 | 6/1968 | Cannon et al. | 57/140 BY |
| 3,413,701 | 12/1968 | Breazeale | 264/290 N UX |
| 3,436,450 | 4/1969 | Specker et al. | 264/290 N X |
| 3,489,832 | 1/1970 | Bruton et al. | 264/290 N UX |
| 3,511,677 | 5/1970 | Strohmaier et al. | 264/290 N UX |
| 3,546,329 | 12/1970 | Hirono et al. | 264/290 N X |
| 3,551,550 | 12/1970 | Bauer et al. | 264/210 F X |
| 3,555,139 | 1/1971 | Waters et al. | 264/290 N X |
| 3,732,346 | 5/1973 | Mallonee et al. | 264/210 F |
| 3,732,346 | 5/1973 | Mallonee et al. | 264/210 F |
| 3,846,532 | 11/1974 | Kubitzker et al. | 264/290 N X |

FOREIGN PATENT DOCUMENTS

| | | | |
|---|---|---|---|
| 181,914 | 5/1955 | Austria | 264/210 F |
| 995,577 | 6/1965 | United Kingdom | 264/290 N |

*Primary Examiner*—Philip Anderson

*Attorney, Agent, or Firm*—Francis W. Young; Jack H. Hall

[57] ABSTRACT

The present process and apparatus are directed to the continuous spinning and drawing of polyamide yarn wherein an aqueous emulsion spin finish is applied to undrawn yarn and the yarn liveliness on the first or winding godet is significantly reduced by use of a first and substantially unheated godet having an increase in diameter from the first to at least the second yarn wrap prior to drawing and take-up.

2 Claims, 3 Drawing Figures

CONTINUOUS MELT SPINNING AND DRAWING OF NYLON 6 YARN, WHILE REDUCING THE LIVELINESS OF THE YARN

This is a continuation of Ser. No. 36,743, filed May 13, 1970 and now abandoned.

BACKGROUND OF THE INVENTION

It is conventional in melt spinning polyamide to spin the melt as filaments into a quenching zone, such as a vertical tower wherein quenching air cools the molten filaments, and to wind up the resulting filaments at the exit from the quenching zone under low tension. A lubricating composition in the form of an aqueous emulsion is commonly applied after drawing and just before the filaments are wound up, to facilitate further processing. Thereafter, the filaments which have been wound are kept in a constant humidity atmosphere and can then be stretched to impart additional molecular orientation and to increase the tenacity. Representative prior techniques are disclosed, for example, in U.S. Pat. Nos. 2,289,860; 2,918,347; and 3,113,369. It is known in the prior art to melt spin both polycaproamide (nylon 6) and polyhexamethylene adipamide (nylon 66), the latter processing being illustrated in U.S. Pat. Nos. 3,090,997 and 3,093,881. One procedure which has been proposed for the continuous spinning and drawing of, for example, polycaproamide, is to draw the filaments while hot in a spinning tower instead of drawing cool yarn as shown, e.g. in U.S. Pat. No. 3,053,611. This procedure, however, is very demanding on apparatus to maintain the high uniformity of tensions, speeds, cooling rates, etc., which are required for good uniformity of the resulting filaments. Such demands are especially difficult to achieve when the yarn consists of a large number of individual filaments, such as 30 filaments or more.

SUMMARY OF THE INVENTION

It has now been discovered that polyamide multifilament yarn having a total denier of about 2,400 to about 11,000 denier (42 to 70 per undrawn filament) can be melt spun, drawn, and wound at high production rates without the intermediate prior art step of winding. The process involves the use of an aqueous emulsion spin finish, which finish is applied prior to drawing and precludes the necessity of adding oil to the drawn yarn either during the spin-drawing or winding operation as a separate and later step. The prior art procedure generally requires heating the spin-draw-winding godets to temperatures greater than 160° C. to reduce yarn shrinkage to an acceptable level. In the present process, an emulsion spin finish is added to the undrawn yarn prior to drawing and take-up; and the winding godet is one which is substantially unheated and has an increase in diameter from first to at least the second yarn wrap. This increase in diameter can be utilized in the form of, for example, a stepped or tapered winding godet; such a godet imposes sufficient tension on the yarn to compensate for the rapid growth of the undrawn yarn after wetting and thereby reduces the liveliness of the yarn on the godet and minimizes emulsion finish losses. The first wrap can be a one-half or full wrap. When a normal cylindrical winding godet is utilized, the liveliness of the yarn warps on the godet is so great that yarn production is not practical as the yarn becomes lively due to absorption of finish (resulting in yarn elongation); the yarn wraps are loose and cross over each other and the last yarn wrap is also loose, this resulting in a variation in yarn denier on drawing. In addition, there is a mechanical loss of yarn finish due to this yarn liveliness and slippage.

PREFERRED EMBODIMENTS

The invention will be more fully understood when considered in conjunction with the accompanying drawings wherein.

Figure 1:
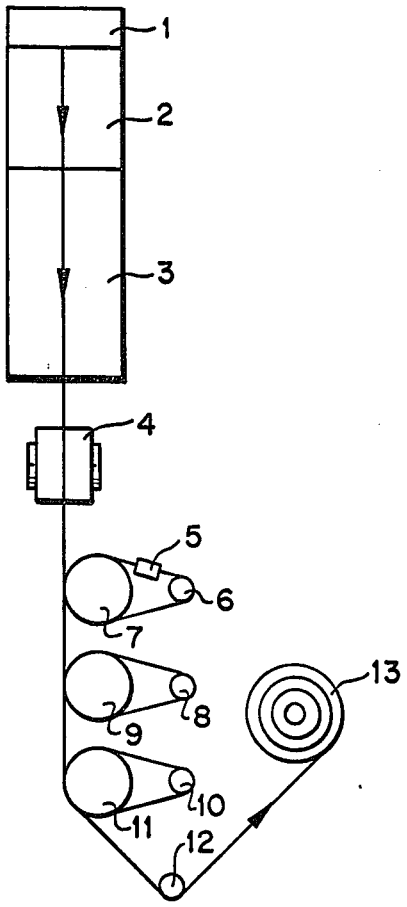
FIG. 1 is a schematic perspective view of the overall system.

Referring to the drawings, FIG. 1 illustrates the overall scheme from the spinning stage to the take-up package. In this figure, polyamide, such as nylon 6, is melt spun and extruded through spinneret 1, cooled or quenched in blow box 2 and then passed through chimney 3 in the conventional manner with the conventional units of equipment. The cooled yarn is then treated with an aqueous emulsion spin finish by applicator 4, such as a stone wheel, and then passed to stepped winding godet 7, this godet being substantially unheated or at most heated to a temperature below the boiling point of water and is of increased diameter from the point of first yarn wrap to at least the second yarn wrap. The yarn is then threaded around winding godet 7 and idler roll 6. A sufficient number of wraps is used to prevent slippage. From the winding godet 7 the yarn passes to draw godet 9 and idler roll 8; said yarn is then passed to draw godet 11 and idler 10, said yarn is then passed to idler roll 12 and then collected in untwisted condition on take-up package 13. The drawing can be effected completely between godets 7 and 9 or partially between 7 and 9 godets with further drawing completed between godets 9 and 11; wrap separator comb 5 is optional.

Figure 2:
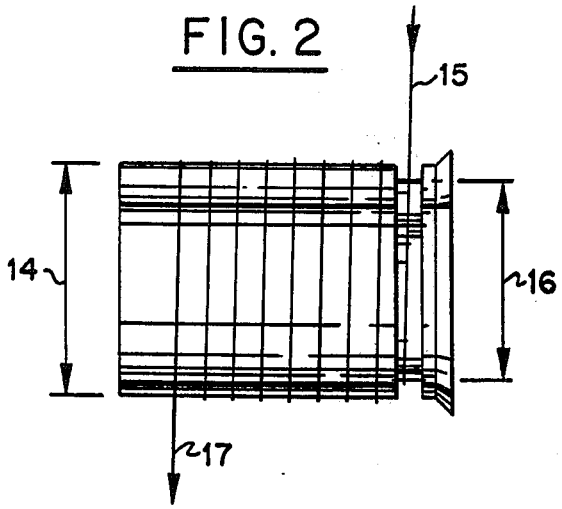
FIG. 2 is an elevational view of a stepped godet.
Figure 3:
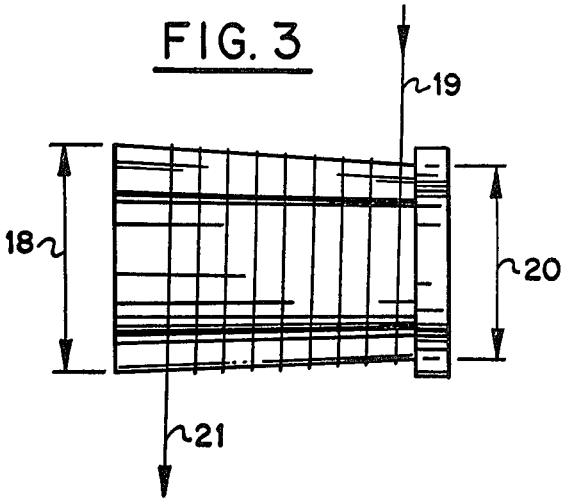
FIG. 3 is an elevational view of a conical godet.

FIGS. 2 and 3 set forth preferred winding godets having an increase in diameter from the first to at least the second yarn wrap. These godets are heated to a temperature below the boiling point of water. FIG. 2 illustrates a stepped winding godet and FIG. 3 a tapered winding godet; in these FIGS. 15 and 19 represent the first yarn wrap and 17 and 21 represent the last yarn wrap and 16 and 20 the small diameters and 14 and 18 the larger diameters.

The particular emulsion spin finish that can be utilized can vary within the skill of the art; a preferred finish can essentially comprise a technical grade mineral oil, a sulfonated vegetable oil, triethanolamine soap, an inorganic soap, water, orthophenylphenol, butyl stearate, and fatty alcohol antistat prepared by ethoxylating (8 mols) a fatty alcohol. This preferred finish formulation can be varied as to components and amounts of said components, routinely within the skill of the art; the selection of the particular emulsion finish is not critical to achieve the significant results herein set forth.

The emulsion finish may be applied by conventional methods, and such a method is preferably illustrated here in the form of a stone wheel. The particular godet types, the number of wraps around said godets, the godet temperatures, and the godet surface speeds can vary within the skill of the art; godet 7, however, is preferably operated at a temperature of from 25° to 100° C. and must have an increase in diameter from the first yarn wrap to at least the second yarn wrap. Godets 9 and 11 can be the conventional normal straight cylindrical godet types and the number of wraps for godets 7, 9 and 11 can vary and preferably are 12, 9 and 8, respectively. A perferred godet temperature for godets 7, 9 and 11 is 40° C., 50° C., and 80° C., respectively. The respective godet surface speeds can preferably be 425, 1610 and 1610 meters per minute for said godets.

Yarn produced according to the present invention has acceptable properties as to moisture and oil retention, percentage boiling water shrinkage, denier, tenacity (gpd), and elongation at break.

The stepped godet of FIG. 2 has a single step but can be modified, within the concept of the present invention, to have several steps, as long as the required increase in diameter is maintained. In addition, it has been found that the use of a stepped or tapered idler roll in combination with, for example, a stepped winding godet gives an even more effective control of the undrawn yarn liveliness; however, the use of such an idler roll is optional. It is also optional to utilize the conventional and known wrap separator comb to also aid, if desired, in reducing the liveliness of the yarn wraps on the winding godet.

Significant advantages offered by the present invention over the conventional and prior method of producing spin-draw-wound yarn are that both oil and water (aqueous emulsions) are added to undrawn yarn in a single step rather than in two separate steps. The yarn reflects an acceptable boiling water skrinkage level with a minimum of heat being applied to the yarn with the further advantage that finish fumes from the yarn are avoided, and, contrary to the procedure of the prior art, the yarn treated is undrawn and results in improved uniformity of moisture along the yarn.

It is known that polyamide yarn, such as nylon 6, increases in length as moisture is absorbed; the liveliness is attributed to rapid growth of the wetted yarn. To compensate for this yarn growth at the first godet and to reduce liveliness, applicants discovered that the first godet must have an increase in diameter from the first to at least the second yarn wrap; said liveliness is then reduced and controlled. This increase in diameter can, for example, be only 2% and can be effectively utilized with an optional comb separator.

EXAMPLE

Yarn produced in the practice of the present invention has the properties suitable for use as a feeder yarn into, e.g., 2500 denier carpet yarn. A specific yarn prepared according to this process utilizing an emulsion spin finish prepared in the manner heretofore described was processed as follows.

Polycaproamide (nylon 6) was melt spun, drawn, and wound continuously as set forth in FIG. 1. This polymer had a relative viscosity of 2.41 (1% solution of polymer in 90% formic acid at 30° C) and was melt spun at a temperature of 285° C; the spun denier was about 8300; the filaments comprised 136 in number; and the spun yarn relative viscosity was 2.45. From spinneret 1 the yarn was passed through cooling chamber (blow box) 2 and cooled with air. From cooling chamber 2, the yarn was passed through chimney 3 and treated with 10% emulsion finish (as heretofore described) applied by stone wheel applicator 4. The treated yarn was then taken up by stepped winding godet 7 and idler roll 6, the number of wraps being sufficient to prevent slippage (i.e., 12). The stepped godet 7 was substantially maintained at a temperature of about 28° C. and the surface speed (mpm) was 425. The yarn was then passed to draw godet 9 maintained at a temperature of about 50° C. and a surface speed (i.e., mpm) of 1610; the yarn then passed over idler roll 8 and then to draw godet 11 and idler roll 10. Draw godet 11 was maintained at about 80° C. and the surface speed (mpm) was 1610. The yarn was then collected in untwisted condition on take-up package 13.

The temperature range over the initial winding godet 7 can be from 25° to about 100° C, and that of draw godet 9 can be from about 25° C. to about 100° C, and that of draw godet 11 can be from about 50° to about 100° C. The surface speed of said draw godet in meters per minute, for example, can be varied within the skill of the art; the draw godets utilized in this example were of the normal straight cylindrical type.

The yarn resulting from the practice of the present invention reflected a moisture content of 3.2, an oil percentage of 1.8, a boiling water shrinkage factor of 12%, a denier of 2185, a tenacity (gpd) of 3.0, and an elongation at break of 39.

In the preceding example, chimney 3 was maintained essentially at room temperature and the emulsion finish utilized was that containing 10% of the finish composition heretofore described. The number of godet wraps on each godet utilized is that number sufficient to prevent slippage. The surface speed in meters per minute of the respective godets can be up to that point which avoids filament breakage, and the take-up speed of the yarn should maintain sufficient tension on the yarn for good package formation.

The first godet is substantially unheated and increases in diameter from the first to at least the second yarn wrap; the size of and the particular godet chosen is not critical; however, as stated before, a tapered and a stepped godet of increased diameter from first to at least the second yarn wrap represent preferred embodiments of the present invention.

The preceding invention illustrations involve the use of nylon 6; however, it is to be understood that polymers wherein polycaproamide is the major ingredient are also similarly processable. For example, polymer blends of a compatible polymer dispersed in polycaprolactam can be processed in generally the same manner as described to give substantially the same results.

The initial winding godet is one of increased diameter from the first yarn wrap to at least the second yarn wrap. This godet is substantially unheated, for example, preferably maintained at a temperature of from 25° to 100° C; the first godet temperature should be below that at which the finish emulsion would fume and/or char; the particular temperature selected will be within the skill of routine evaluation of both operation conditions and specific finish emulsion utilized.

Other modifying agents also can be present, such as pigments, stabilizers, lubricants, etc., e.g., as disclosed in U.S. Pat. Nos. 2,705,227 and 3,342,134.

This process has utility for linear fiber-forming polyamides generally, such as those polyamides disclosed in U.S. Pat. Nos. 2,071,250; 2,071,253; and 2,130,948. An antioxidant can be added to the polyamide, such as those disclosed in U.S. Pat. Nos. 2,705,227; 2,640,044; and 2,630,421. Other useful additives include those disclosed in U.S. Pat. Nos. 2,510,777 and 2,345,700. It is also within the purview of this invention that conventional delustrants and other additives can be utilized.

In this specification, the term "polyamide yarn" designates strands, filaments, or multifilaments, or tows of polyamide. It is preferred in the practice of this invention that plural continuous filaments of polyamide be processed with the understanding that said filaments can contain the conventional additives and modification agents as may be desired for a given formulation and end result. Both textile and higher denier yarn, i.e., that for tire cord and carpet, can be processed according to this invention.

What is claimed is:

1. A process for continuously melt spinning and drawing nylon 6 to form a yarn comprising the steps of melt extruding said yarn, applying an aqueous emulsion finish to said yarn immediately after extrusion, thereby causing lengthening of and liveliness in said yarn, passing said yarn while in an undrawn state through at least two stages of a substantially unheated winding zone, increasing the rate of speed of the yarn at least between the first and second stages of passage within said winding zone an amount sufficient to compensate for said yarn lengthening and to thereby reduce the yarn liveliness resulting therefrom, and drawing said yarn away from the last stage of said winding zone.

2. In a process for continuously melt spinning a nylon 6 yarn, wrapping said yarn around a substantially unheated winding godet in multiple wraps sufficient to eliminate slippage, drawing said yarn, and applying an aqueous emulsion finish to said yarn after spinning but before drawing thereby causing lengthening of and liveliness in said yarn on said winding godet, the improvement which comprises increasing the speed of said yarn at least about 2% from the first to at least the second of said multiple yarn wraps an amount sufficient to compensate for said yarn lengthening and to thereby reduce the yarn liveliness resulting therefrom.

* * * * *